US005327700A

United States Patent [19]

Sorenson et al.

[11] Patent Number: 5,327,700

[45] Date of Patent: Jul. 12, 1994

[54] COLLAPSIBLE MODULAR DISPLAY TOWER ASSEMBLY

[75] Inventors: Gary R. Sorenson, Lakeville; Philip C. Gerberding, Hopkins, both of Minn.

[73] Assignee: Skyline Displays, Inc., Burnsville, Minn.

[21] Appl. No.: 803,157

[22] Filed: Dec. 5, 1991

[51] Int. Cl.[5] ..... E04H 12/18

[52] U.S. Cl. ..... 52/109; 52/646; 52/651.01; 52/638; 52/645

[58] Field of Search ..... 52/109, 646, 651.01, 52/651.07, 651.1, 637, 638, 645, 651.09; 135/107, 108; 40/610

[56] References Cited

U.S. PATENT DOCUMENTS

| | | | |
|---|---|---|---|
| 3,190,405 | 6/1965 | Squire | 52/651.1 X |
| 3,354,596 | 11/1967 | Schafer | 52/646 |
| 3,968,808 | 7/1976 | Zeigler | 135/4 |
| 4,026,313 | 5/1977 | Zeigler | 135/4 |
| 4,126,974 | 11/1978 | Hardin | 52/109 |
| 4,276,726 | 7/1981 | Derus | 52/109 |
| 4,290,244 | 9/1981 | Zeigler | 52/80 |
| 4,437,275 | 3/1984 | Zeigler | 52/109 |
| 4,471,548 | 9/1984 | Goudie | 40/610 |
| 4,473,986 | 10/1984 | Zeigler | 52/645 |
| 4,561,618 | 12/1985 | Zeigler | 248/166 |
| 4,579,066 | 4/1986 | Zeigler | 108/157 |
| 4,627,210 | 12/1986 | Beaulieu | 52/646 |
| 4,658,560 | 4/1987 | Beaulieu | 40/610 |
| 4,689,932 | 9/1987 | Zeigler | 52/648 |
| 4,791,761 | 12/1988 | Goudie | 52/109 |
| 4,888,895 | 12/1989 | Kemeny | 52/109 X |
| 4,942,686 | 7/1990 | Kemeny | 52/109 X |
| 4,947,884 | 8/1990 | Lynch | 52/109 X |
| 4,970,841 | 11/1990 | Zeigler | 52/646 |
| 5,123,550 | 6/1992 | Nodskov et al. | 211/189 |
| 5,148,648 | 9/1992 | Sorenson et al. | 52/646 |
| 5,167,100 | 12/1992 | Krishnapillai | 52/109 |

*Primary Examiner*—Carl D. Friedman
*Assistant Examiner*—Beth A. Aubrey
*Attorney, Agent, or Firm*—Palmatier, Sjoquist & Helget

[57] ABSTRACT

A collapsible modular display tower assembly has a three-dimensional, collapsible display panel structure having two opposing pairs of pivotally-connective links with upper and lower ends arranged to form four side faces when erect. A plurality of upper and lower hub assemblies are pivotally connecting the adjacent ends of the links of adjacent side faces. Four vertically-oriented expansible support and attachment braces are provided with each brace being connected to one pair of the vertically-aligned upper and lower hub assemblies. The braces permit the attachment of graphic representations and display accessories to the tower assembly. Releasable hub-connecting means in the form of male and female connectors are provided on the upper and lower hub assemblies for releasably interlocking a multiplicity of display panel structures into a vertical display tower.

25 Claims, 4 Drawing Sheets

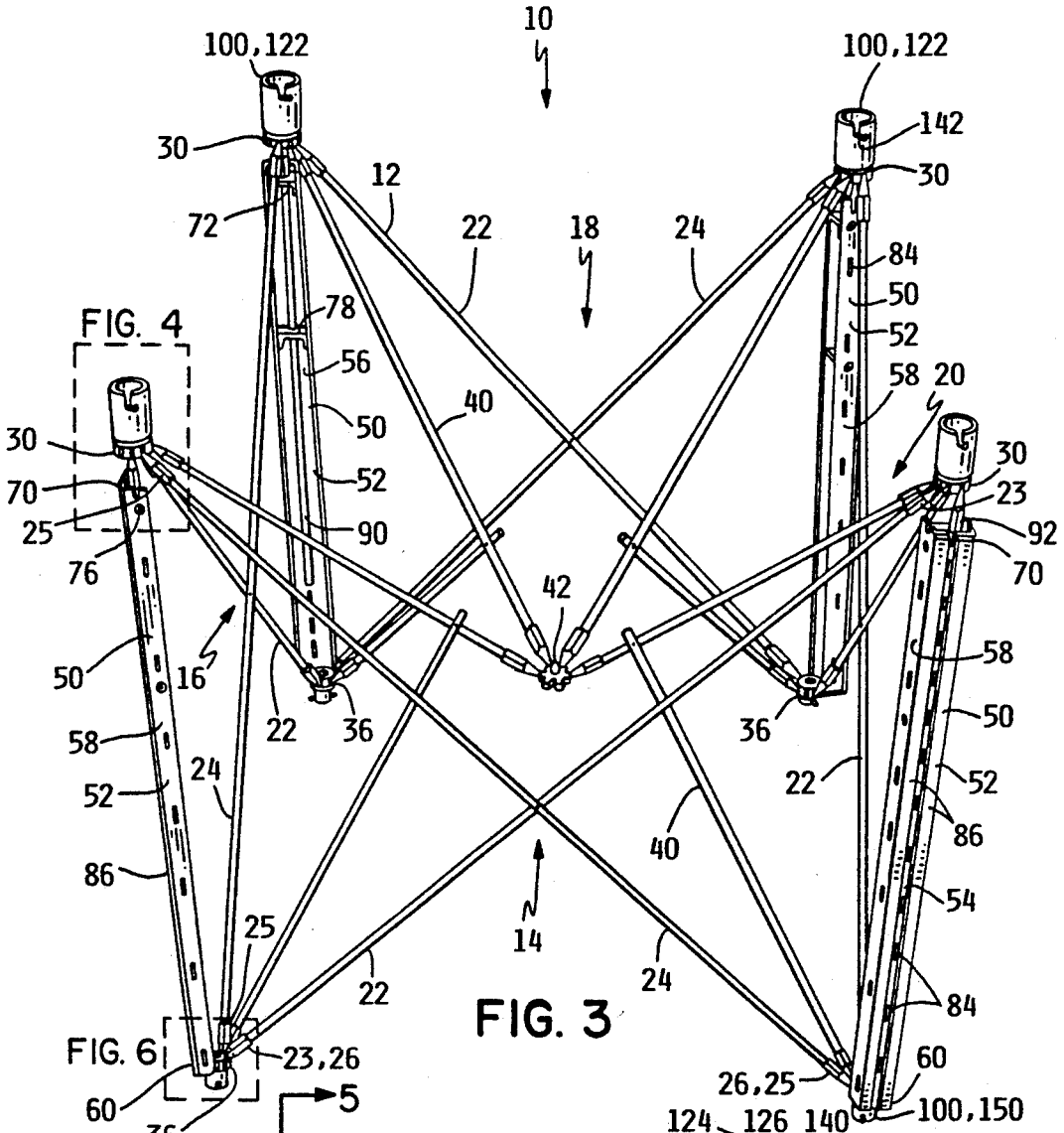
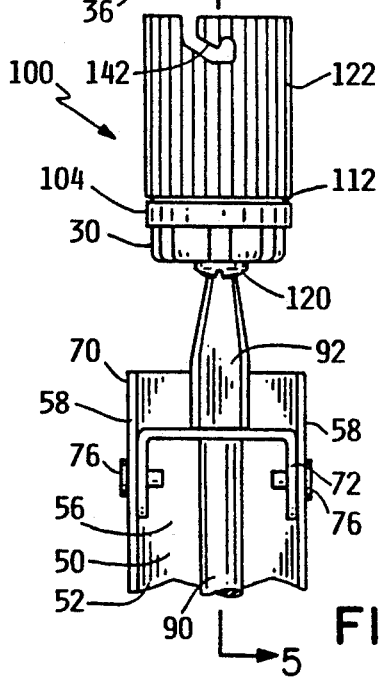
FIG. 4
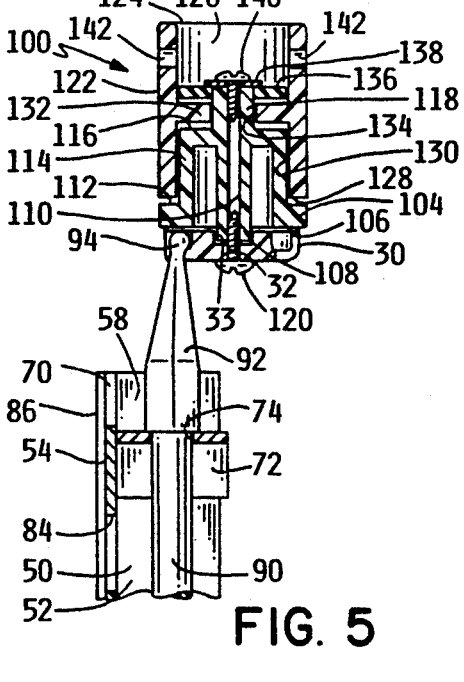
FIG. 5

COLLAPSIBLE MODULAR DISPLAY TOWER ASSEMBLY

BACKGROUND OF THE INVENTION

This invention relates to collapsible, self-supporting structures, and more particularly to a collapsible modular display tower assembly for the four-sided displaying of graphic representations and for the attaching of display accessories upon any of the four sides.

Collapsible self-supporting structures typically have a network of support rods or links which are pivotally joined together in a scissors-like arrangement. While some rods or links are intermediately joined for pivotal movement, other links are pivotally joined together at their ends by hub assemblies for movement between a collapsed, compact position for storage or transportation and an open or erect condition in which the desired structural shape is attained. Dome, panel or arch-shaped structures of this type are known.

Collapsible display panel or wall structures of the type having planar or arcuate face surfaces are commercially available and quite useful for trade shows and the like. Often the collapsible display panel structures are typically covered by a sheet of material adapted for either covering the front of the panel structure or displaying a graphic representation. The portable structures may then be used to form the backdrop of a trade show booth. These structures require a complex maze of interconnected pivots and links forming arcuate structures and surfaces rather than planar surfaces or structures. The complex enlarged panel structures do have some other drawbacks in that they are generally light in weight and lack in any vertical supportive strength.

There is a need for a collapsible modular display tower assembly that occupies little square footage on the ground or floor at a trade show. Such a tower assembly should be planar and modular in that multiple structures could be vertically arranged to form a tower and to create a four-sided display structure. Such a structure should be able to bear substantial weight for displaying graphic representations and supporting display accessories to vertical heights heretofore not known.

SUMMARY OF THE INVENTION

A collapsible modular display tower assembly has a three-dimensional collapsible display panel structure having two opposing pairs of pivotally-connective links with upper and lower ends arranged to form four side faces when erect. A plurality of upper and lower hub assemblies are pivotally connecting the adjacent ends of the links of adjacent side faces. Four vertically-arranged expansible support and attachment braces are provided with each brace being connected to one pair of the vertically-oriented upper and lower hub assemblies. The braces permit the attachment of graphic representations and display accessories to the tower assembly. Releasable hub-connecting means in the form of male and female connectors are provided on the upper and lower hub assemblies for releasably interlocking a multiplicity of display panel structures into a vertical display tower.

A principal object and advantage of the present invention is that it permits the assembly of a substantially high four-sided, planar display tower occupying minimal floor surface area. Such a tower is ideal for the front of a trade show booth in that substantial graphic representations may be displayed with minimum usage of square footage.

Another principal object of the present invention is that the braces permit the vertical assemblage of display panel structures and the connecting of display accessories thereto without fear of a lack of vertical supportive strength, as weight is carried by the braces.

Another object and advantage of the present invention is that the present collapsible modular display tower assembly has all of its components connected thereto for easy collapse or erection without the need for additional or supplemental assembly of further elements or subparts.

Yet another advantage and object of the present invention is that the individual display tower assemblies have all of their components connected thereto for easy modular assembly of a tower without any fear of losing any components or elements during its storage, transportation, erection or breaking down.

BRIEF DESCRIPTION OF THE DRAWINGS

FIG. 3 is a front perspective view of the erected collapsible modular display tower assembly of the present invention;

FIG. 4 is an enlarged detailed view of the expansible brace, hub and releasable female hub-connecting means taken from the phantom box of FIG. 3 with several links removed;

FIG. 5 is a cross-sectional view essentially taken along lines 5—5 of FIG. 4;

DETAILED SPECIFICATION

Figure 1:
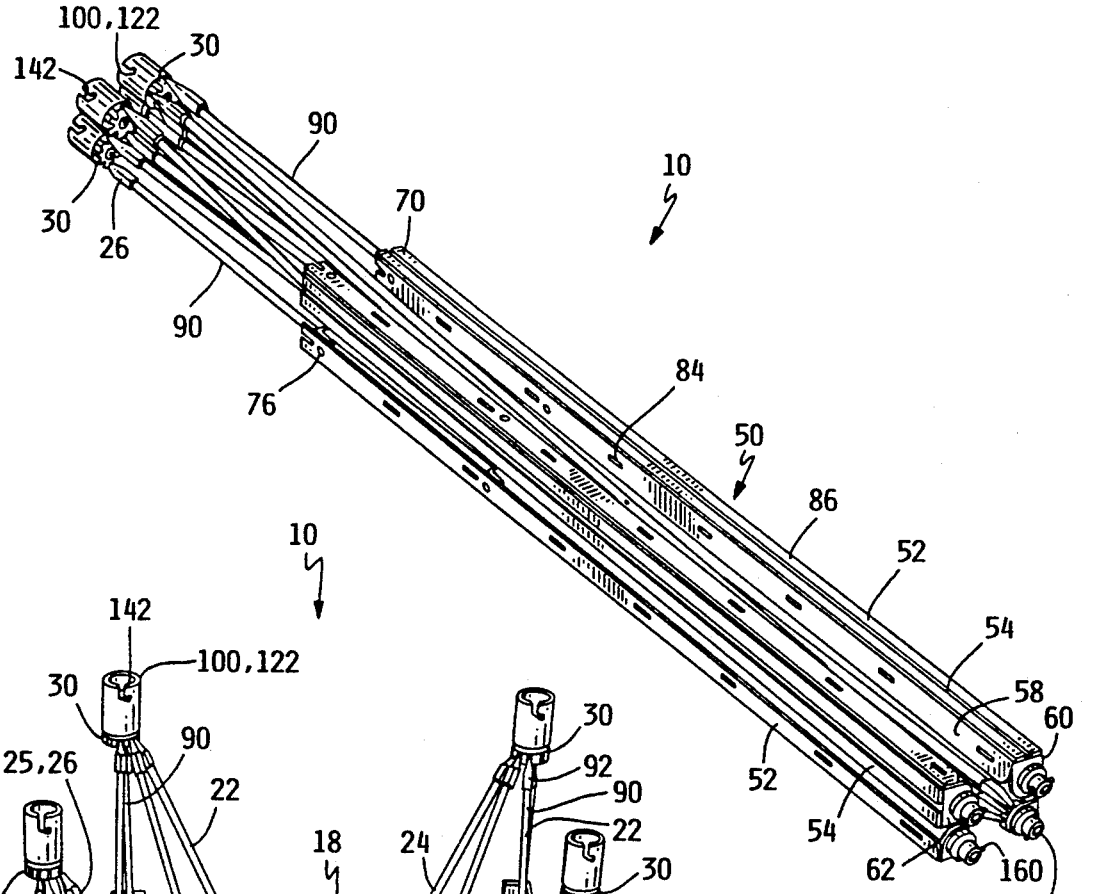
FIG. 1 is a perspective view of the collapsed modular display tower assembly of the present invention in its collapsed condition.
Figure 2:
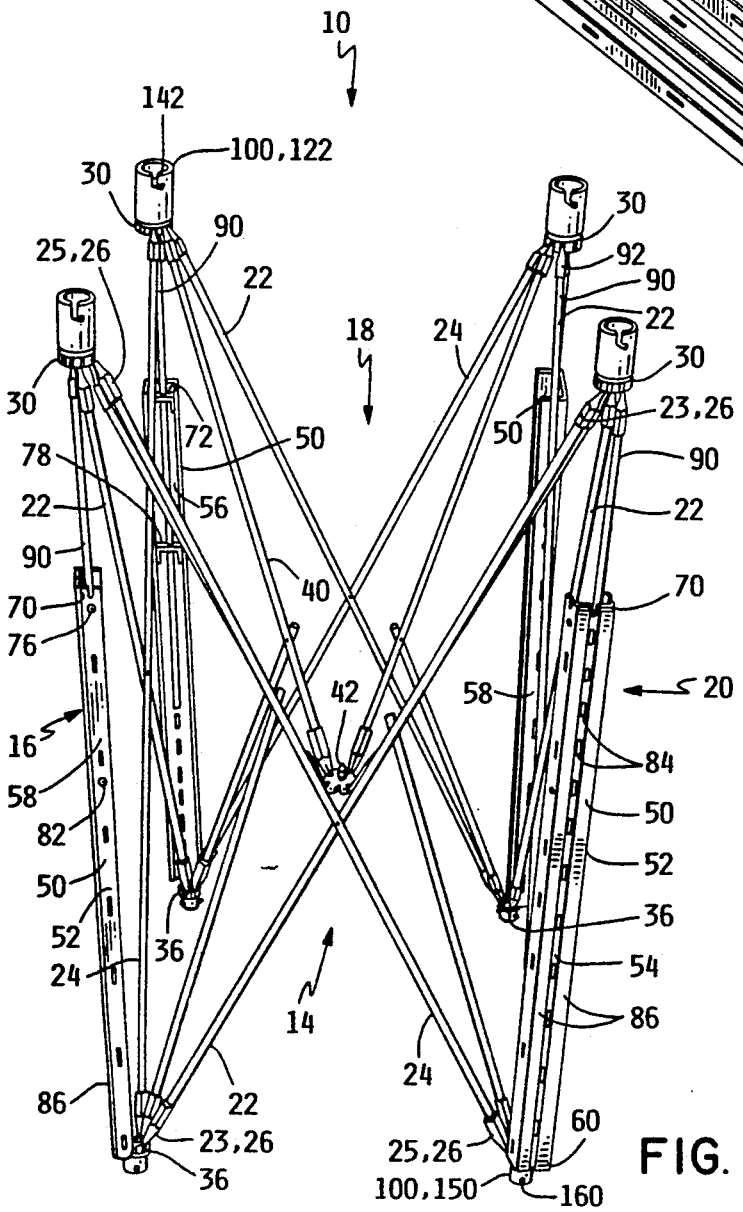
FIG. 2 is a front perspective view of the present invention in a partially erected condition.
Figure 6:
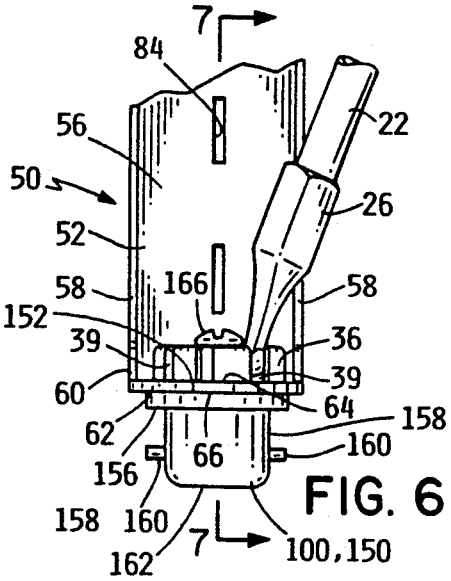
FIG. 6 is an enlarged detailed view of the brace hub and male hub-connecting means taken from the phantom box of FIG. 3 with several links removed for clarity.
Figure 7:
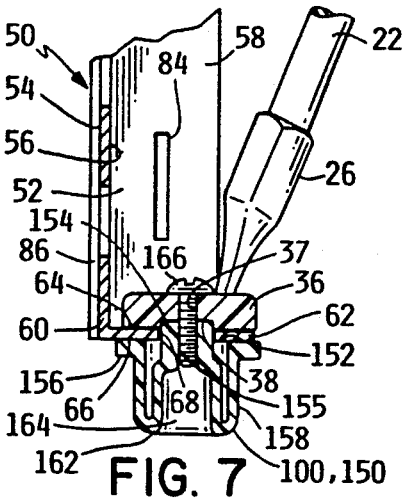
FIG. 7 is a cross-sectional view taken along lines 7—7 of FIG. 6.
Figure 8:
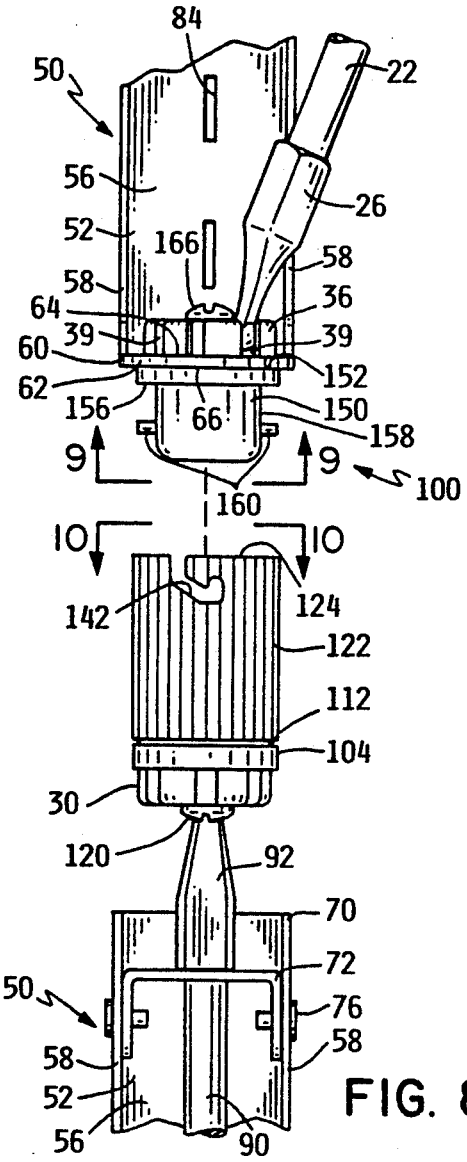
FIG. 8 is an exploded view of the male and female hub-connecting means of the present invention in vertical alignment and ready for vertical assembly of a display tower.
Figure 9:
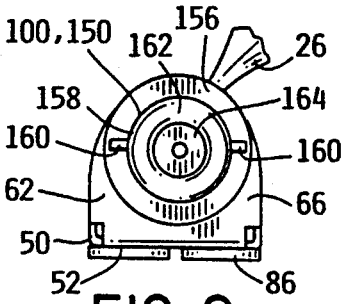
FIG. 9 is a view taken along lines 9—9 of FIG. 8.
Figure 10:
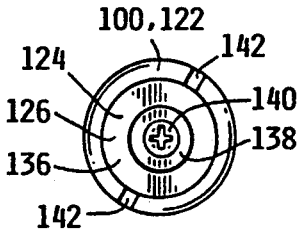
FIG. 10 is a view taken along lines 10—10 of FIG. 8.
Figure 13:
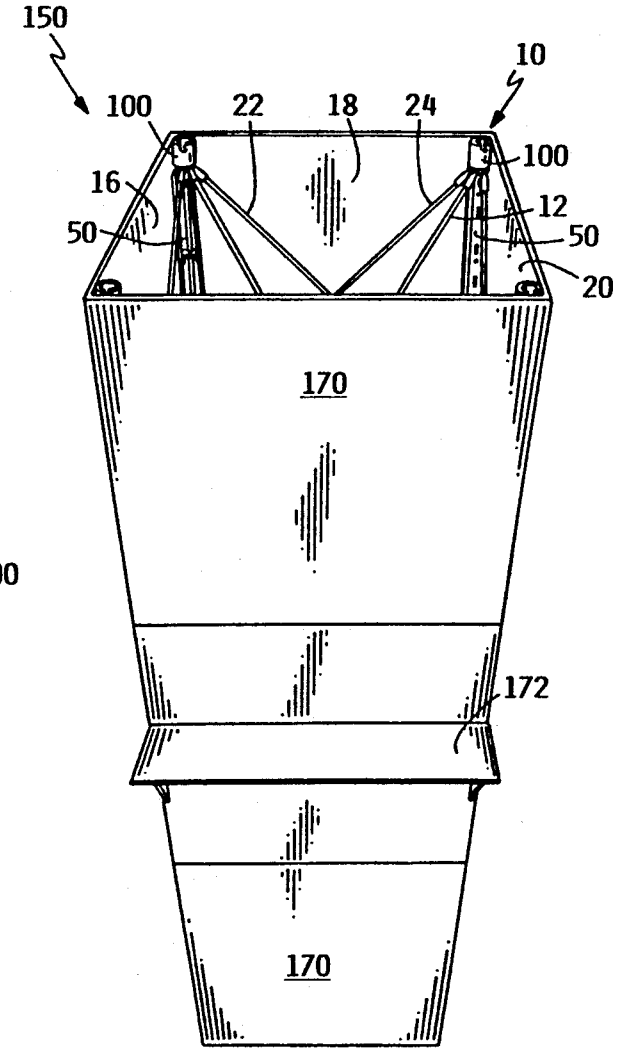
FIG. 13 is a front perspective view of the assemblies of the present invention vertically connected into the formation of a display tower showing graphic display panels and a display accessory in the form of a shelf.
Figure 12:
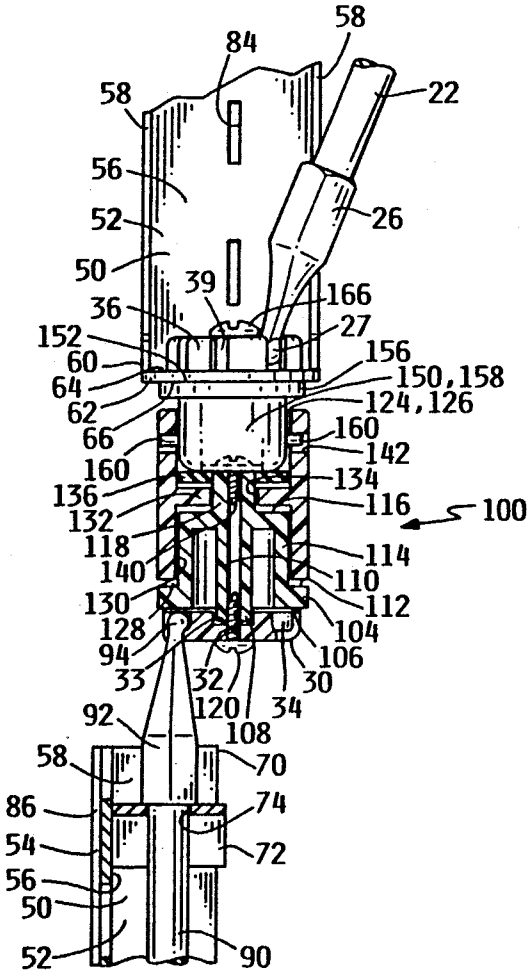
FIG. 12 is a side elevational view with portions broken away for clarity of the releasable male and female hub-connecting means of the present invention interlocked together.
Figure 11:
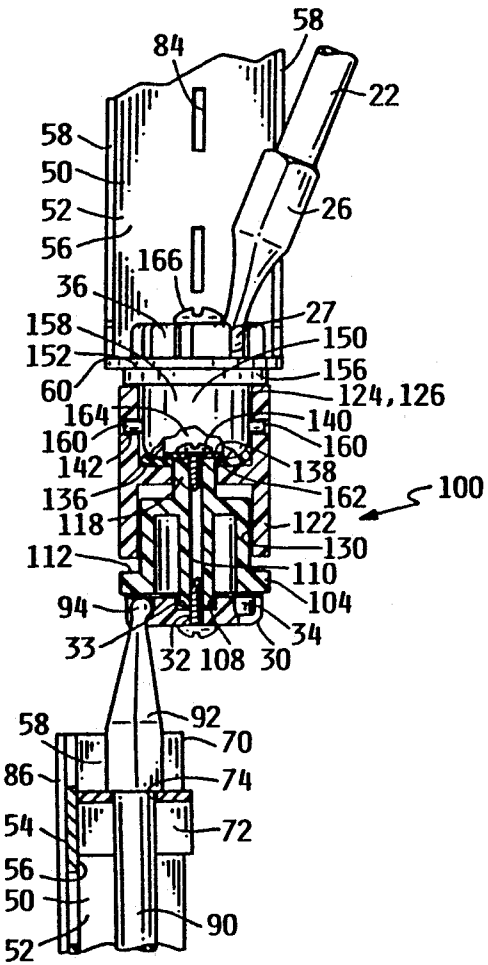
FIG. 11 is a side elevational view of the male and female releasable hub-connecting means being joined and interlocked together with portions partially broken away for clarity.

Referring to FIGS. 1—3, the collapsible modular display tower assembly 10 generally includes a three-dimensional, collapsible display panel structure 12 comprised of pivotally-connected links or support rods 22, 24 and 40 held by like hub assemblies 30, 36 and 42. By this arrangement, the structure 12 forms four adjacent side faces 14, 16, 18 and 20 when erect. The hub assemblies 30 and 36 are interconnected by expansible support and attachment braces 50. The upper and lower hub assemblies 30 and 36 have releasable hub-connecting means 100 which will permit the secure stacking of a multiplicity of tower assemblies 10 to create the sturdy vertical display tower 150 as shown in FIG. 13 which is capable of supporting display accessories and graphics.

More specifically, the collapsed or folded display panel structure 10 of FIG. 1 is to be vertically oriented and gently pulled apart beyond the intermediate portion of FIG. 2 to its complete erect position of FIG. 3. The structure 12 has side faces 14, 16, 18 and 20. The faces are each comprised of a pair of pivotally-connected links or support rods 22 and 24. The links 22 and 24 each respectfully have link ends 23 and 25 with caps 26 with spherical heads 27 for pivotal connection within the upper and lower hub assemblies 30 and 36. The upper hub assemblies 30 are essentially in a horizontal plane and each has a central aperture or hole 32 therethrough with a configured recess 33 therearound on the top side of the hub assembly 30. An array of circumferential sockets 34 are located around the periphery of hub assembly 30. Likewise, the lower hub assemblies 36 are also in a horizontal plane just below that of the upper hub assemblies 30. Each lower hub assembly 36 has a central hole or aperture 37 therethrough with a configured recess 38 on the lower side of the hub assembly 36. An array of peripherally-aligned sockets 37 are also arranged in each hub assembly 36. The sockets 34 and 39 permit the pivotal connection of links 22 and 24 at their respective ends 23 and 25 thereby forming the side faces 14, 16, 18 and 20. There is also a central connecting array of links 40 which connect the side faces 14, 16, 18 and 20 with central hub 42. The hub assembly structures can be viewed in somewhat more detail in FIGS. 4–8.

Referring to FIGS. 1–12, the collapsible modular display tower assembly 10 has four like expansible support and attachment braces 50 at the corners of the side faces 14, 16, 18 and 20 connecting the upper and lower hub assemblies 30 and 36 of the display panel structure 12. Each brace 50 has an elongate rigid support bar 52. The support bar 52 has an outer front face or wall 54, inner back wall 56 and integral stiffening side walls 58. The lower end 60 of bar 52 is appropriately turned inwardly to form a mounting ear 62 which has a top side 64 and bottom side 66 with an aperture or hole 68 therethrough. At the upper end 70 is located bracket 72 which appears as an upside down U-shaped piece having an aperture 74 therethrough. Bracket 72 is fixed to the side walls 58 along the inner or back wall 56 by way of rivets or screws 76. There is also a like intermediate bracket 78 having an aperture therethrough similarly affixed to side walls 58 by way of rivets 82.

Rigid support bar 52 also has vertically-oriented slots 84 suitably aligned in front and side walls 54 and 58 for connection of display accessories to the bar 52. The front face 54 of the bar 52 also has magnetic strips 86 suitably affixed thereto for connecting graphic representation panels thereto. Slots 84 and strips 86 comprise the means for releasably attaching display accessories and graphic representations as further described herein and shown in FIG. 13.

Extensive rod, link or bar 90 is slidably mounted in the apertures of brackets 72 and 78, respectively. Extensive rod or link 90 has an enlarged cap portion 92 affixed to its upper end having a spherical head 94 for pivotal interlocking within one of the sockets 34 of upper hub 30 shown in the figures.

As can be generally seen in FIGS. 1–3 and more specifically viewed in FIGS. 4, 5, 8, 11 and 12, the caps 26 of upper link ends 23 and 25 as well as the cap 92 of slidably-mounted extensive link 90 are pivotally interlocked within the sockets 34 of upper hub assemblies 30. They are suitably pivotally interlocked by the hub extensions 104 of the releasable hub-connecting means 100 which are securely connected to the upper side of the upper hub assemblies 30. That is, hub extension 104 has a bottom face 106 with a hub index portion 108 alignable within the configured recess 33 of the upper hub assemblies 30. The bore, aperture or hole 110 through the hub extension 104 is thereby in line with the hole 32 through the upper hub assembly 30. Hub extension 104 suitably has a shoulder 112, cylindrical intermediate portion 114, top face 116, and a raised cylindrical bearing portion 118. Screw 120 suitably secures upper hub assembly 30 to extension 104 as to pivotally interlock or capture spherical heads 27 and 94 within the upper hub assemblies 30. For clarity, only the cap 92 and spherical head 94 of the extensive link 90 are shown which is like cap 26 at the link ends 23 and 25 of the pivotally-connected links 22 and 24 and at the ends of the central array of links 40.

Again, referring to FIGS. 5, 8, 10, 11 and 12, the female hub connector 122 of the releasable hub-connecting means 100 may be clearly seen. Female hub connector 122 is generally hollow and cylindrical in shape with a knurled outer surface for easy hand gripping. Connector 122 has an open top 124 leading into upper cavity 126 and an open bottom 128 leading into lower cavity 130. Cavities 126 and 130 are divided by an inner collar or dividing wall 132 having a circular opening 134 therethrough communicating with cavities 126 and 130. At the bottom of upper cavity 126 adjacent inner collar 132 is located a compressible washer 136 suitably made of any elastomer or foam-like rubber. Above compressible washer 136 is located a rigid washer 138. Screw 140 passes through washers 138 and 136 and is suitably turned into the hole 110 of the raised cylindrical bearing portion 118 passing through circular opening 134 of dividing wall 132. It will be observed that the raised cylindrical bearing portion 118 is somewhat elongate as to not tightly bind the female hub connector 122 to the hub extension 104. By this arrangement, the female hub connector 122 may be easily rotated by hand for the desired positioning or location of the curved or hooked-shaped opposing slots 142 which will be appreciated further herein.

The male hub connector 150 of the releasable hub-connecting means 100 is more clearly seen in FIGS. 6–9 and 11 and 12. Male hub connector 150 has a top face 152 with a hub index raised portion 154 which fits into the configured recess 38 of one of the lower hub assemblies 36. By this arrangement, hole or bore 155 through connector 150 is aligned with the central hole 37 of the lower hub assembly 36 into which screw 166 is turned and fastened thus fastening the male hub connector 150 to the lower hub assembly 36 and captivating the spherical heads 27 of the lower link ends 23 and 25. Hub connection 150 also has a shoulder 156 and a cylindrical portion 158 with opposing index knobs, pegs or fingers 160. The pegs 160 are alignable within the hook-shaped opposing slots 142 for releasably connecting the male and female connectors 122 and 150 of the releasable hub-connecting means 100. Male hub connector 150 also has a bottom annular rim 162 leading into inner cavity 164.

By these described structures, the lower hub assemblies 36 sandwich the top and bottom sides 64 and 66 of the inwardly-turned ears 62 and rigidly connected to the male hub connectors 150. From hub assemblies 36 the pivotal links 22, 24 and 40 extend from the lower ends 60 of the elongate rigid support bars 52. Extensible links 90 slidably mounted in bars 52 have their cap ends 92 pivotally secured to the upper hub assemblies 30 along with the upper ends of pivotal links 22, 24 and 40 which are not directly connected to rigid bars 52.

As can be seen in FIGS. 1–3, when the collapsible modular display tower structure is collapsed, the extensive links 90 extend their maximum amount from rigid support bars 52. When the assembly 10 is vertically oriented and gently pulled apart, the links 90 slide into the brackets 72 and 78 of rigid support bar 52 until enlarged cap portion 92 contacts the top bracket 72 and the tower assembly is considered to be fully erect with the vertically-arranged rigid support bars 52 capable of supporting weight.

Referring to FIGS. 8–12, the assembly and operation of the releasable hub-connecting means 100 will now be discussed and appreciated. With one modular display tower assembly 10 vertically erect or partially erect, a second modular display tower assembly 10 may be located vertically overhead as to align the female hub connectors 122 with the male hub connectors 150 of connecting means 100 specifically shown in FIG. 8. The female connector 122 then is freely rotated by hand as to orient the hook-shaped opposing slots 142 to receive the pegs 160 of the male hub connectors 150. Next, the shoulder 156 of the male hub connector is pushed or forced downwardly to meet the open top 124 of the female hub connector 122 and slightly rotated. By this action, the inner cavity 164 of the male hub connector 150 receives the rigid washer 138 and screw 140. Simultaneously, the bottom annular ring 102 begins to move the compressible washer 136 downwardly against dividing wall 132 and to compress slightly to permit the pegs 160 to interlock in the slots 142 after which the cylindrical portion 158 of the male hub connector 150 comes upwardly somewhat and is held thereat by action of the compressible washer 136. Now, the female hub connector 122 and the male hub connector 150 are releasably interconnected forming the releasable hub-connecting means 100. This action is the same for each connector 122 and 150 of the assembly 10. The release of the male and female connectors 122 and 150 follow the reverse action by depressing the male hub connector 150 downwardly and slightly rotating the pegs as they will come upwardly out of opposing slots 142.

A plurality of multiplicity of modular display tower assemblies 10 can be vertically stacked securely by the releasable hub-connecting means 100. As shown in FIG. 13, the weight of tower 150 is borne by the elongate rigid support bars 52 at each corner of side faces 14, 16, 18 and 20. The magnetic strips 86 permit the releasable attachment of graphic representation panels 170 while the aligned slots 84 will permit attachment for display accessories such as shelf 172.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed is:

1. A collapsible modular display tower assembly for displaying graphic representations and for attaching display accessories thereto, comprising:

(a) a three-dimensional, collapsible display panel structure having two opposing pairs of upwardly and downwardly directed pivotally-connected links with ends, the ends of one pair being arranged adjacent the ends of the other pair, the structure arranged to form four vertical side faces when erect and an array of links centrally connecting the side faces;

(b) a plurality of upper and lower hub assemblies pivotally connecting the adjacent ends of the links of the side faces that are adjacent;

(c) a plurality of expansible support and attachment braces each brace having two ends each of which is connected to one of the upper and lower opposing hub assemblies; and (d) releasable hub-connecting means comprised of male and female connectors on the upper and lower hub assemblies for releasably interlocking a multiplicity of display panel structures into a vertical display tower.

2. The assembly of claim 1, wherein the brace comprises an elongated rigid support bar and a rod slidably telescoped within the bar.

3. The assembly of claim 1, further comprising second means on the braces for releasably attaching graphic representation panels to the assembly.

4. The assembly of claim 3, wherein the second means comprises a magnetic strip on each brace.

5. The assembly of claim 1, further comprising third means on the braces for releasably attaching display accessories to the assembly.

6. The assembly of claim 5, wherein the third means comprises a plurality of aligned slots in the braces.

7. The assembly of claim 1, wherein the braces are vertically oriented and parallel with respect to one another.

8. The assembly of claim 1, wherein the releasable hub-connecting means comprise releasably-interlockable male and female connectors, one connector fastened to one hub while the other connector is fastened to the other opposing and vertically-aligned hub.

9. A collapsible modular display tower assembly for displaying graphic representations and for attaching display accessories thereto, comprising:

(a) a three-dimensional, collapsible display panel structure having two opposing pairs of upwardly and downwardly directed pivotally-connected links with upper and lower ends, the ends of one pair being arranged adjacent the ends of the other pair, the structure arranged to form four vertical side faces when erect and an array of links centrally connecting the side faces;

(b) a plurality of upper and lower hub assemblies vertically alignable in pairs pivotally connecting the adjacent ends of the links of the side faces that are adjacent;

(c) for vertically-oriented expansible support and attachment braces, each brace being connected to one pair of the vertically-aligned upper and lower hub assemblies; and (d) releasable hub-connecting means comprised of male and female connectors on the upper and lower hub assemblies for releasably interlocking a multiplicity of display panel structures into a vertical display tower.

10. The assembly of claim 9, wherein the brace comprises an elongate rigid support bar and a rod slidably telescoped within the bar.

11. The assembly of claim 9, further comprising second means on the brace for releasably attaching graphic representation panels to the assembly.

12. The assembly of claim 11, wherein the second means comprises a magnetic strip on each brace.

13. The assembly of claim 9, further comprising third means on the braces for releasably attaching display accessories to the assembly.

14. The assembly of claim 13, wherein the third means comprises a plurality of aligned slots in the braces.

15. The assembly of claim 9, wherein the braces are vertically oriented and parallel with respect on one another.

16. The assembly of claim 9, wherein the releasable hub-connecting means comprise releasably-interlockable male and female connectors, one connector fastened to one hub while the other connector is fastened to the other opposing and vertically aligned hub.

17. A collapsible modular display tower for displaying graphic representations and for attaching display accessories thereto, comprising:

(a) a plurality of three-dimensional, collapsible display panel structures each having two opposing pairs of upwardly and downwardly directed pivotally-connected links with upper and lower ends, the ends of one pair arranged adjacent the ends of the other pair, the structure arranged to form four vertical side faces when erect and an array of links centrally connecting the side faces;

(b) each display panel structure having a plurality of upper and lower hub assemblies vertically alignable in pairs pivotally connecting the adjacent ends of the links of the side faces that are adjacent;

(c) each display panel structure having four vertically-oriented expansible support and attachment braces, each brace being connected to one pair of the vertically-aligned upper and lower hub assemblies of each structure; and (d) releasable hub-connecting means comprised of male and female connectors on the upper and lower hub assemblies for releasably interlocking a multiplicity of display panel structures into the vertical display tower.

18. The assembly of claim 17, wherein the brace comprises an elongate rigid support bar and a rod slidably telescoped within the bar.

19. The assembly of claim 17, further comprising second means on the braces for releasably attaching graphic representation panels to the assembly.

20. The assembly of claim 19, wherein the second means comprises a magnetic strip on each brace.

21. The assembly of claim 17, further comprising third means on the braces for releasably attaching display accessories to the assembly.

22. The assembly of claim 21, wherein the third means comprises a plurality of aligned slots in the braces.

23. The assembly of claim 17, wherein the braces are vertically oriented and parallel with respect to one another.

24. The assembly of claim 17, wherein the releasable hub-connecting means comprise releasably-interlockable male and female connectors, one connector fastened to one hub while the other connector is fastened to the other opposing and vertically-aligned hub.

25. A collapsible modular display tower assembly for displaying graphic representations and for attaching display accessories thereto, comprising:

(a) a three-dimensional, collapsible display panel structure having two opposing pairs of upwardly and downwardly directed pivotally-connected links with upper and lower ends, the ends of one pair being arranged adjacent the ends of the other pair, the structure arranged to form four vertical side faces when erect and an array of links centrally connecting the side faces;

(b) a plurality of upper and lower hub assemblies vertically alignable in pairs pivotally connecting the adjacent ends of the links of the side faces that are adjacent;

(c) four vertically-oriented expansible support and attachment braces, each brace being connected to one pair of the vertically-aligned upper and lower hub assemblies as to permit collapse and erection of the assembly;

(d) first releasable hub-connecting means on the upper and lower hub assemblies comprised of releasably-interlockable male and female connectors for releasably interlocking a multiplicity of display panel structures into a vertical display tower; and (e) seconds means on the braces for releasably attaching graphic representation panels to the assembly.

* * * * *